United States Patent [19]

Kamp

[11] 4,089,480

[45] May 16, 1978

[54] WINDING APPARATUS FOR FRICTION-DRIVEN CONICAL CROSS-WOUND COILS

[75] Inventor: Heinz Kamp, Rickelrath, Germany

[73] Assignee: W. Schlafhorst & Co., Monchen-Gladbach, Germany

[21] Appl. No.: 640,221

[22] Filed: Dec. 12, 1975

[30] Foreign Application Priority Data

Dec. 12, 1974 Germany ..... 2458853

[51] Int. Cl.[2] ..... B65H 54/42

[52] U.S. Cl. ..... 242/18 DD; 242/18 CS; 242/43 R; 242/45

[58] Field of Search ..... 242/18 DD, 18 CS, 18 R, 242/43 R, 45

[56] References Cited

U.S. PATENT DOCUMENTS

| | | | |
|---|---|---|---|
| 1,277,933 | 9/1918 | Holt et al. | 242/18 DD |

FOREIGN PATENT DOCUMENTS

| | | | |
|---|---|---|---|
| 1,912,374 | 5/1970 | Germany | 242/18 DD |
| 21,652 of | 1910 | United Kingdom | 242/18 DD |
| 21,653 of | 1910 | United Kingdom | 242/18 DD |

*Primary Examiner*—Stanley N. Gilreath
*Attorney, Agent, or Firm*—Herbert L. Lerner

[57] ABSTRACT

In apparatus for winding a friction-driven conical cross-wound coil, at least one first rotating member in the form of a body of rotation disposed so as to support the coil at the peripheral surface thereof from below without directly driving the coil by friction, and a second rotating member engaging the peripheral surface of the coil from below for effecting direct frictional drive of the coil.

11 Claims, 6 Drawing Figures

Figure 1:
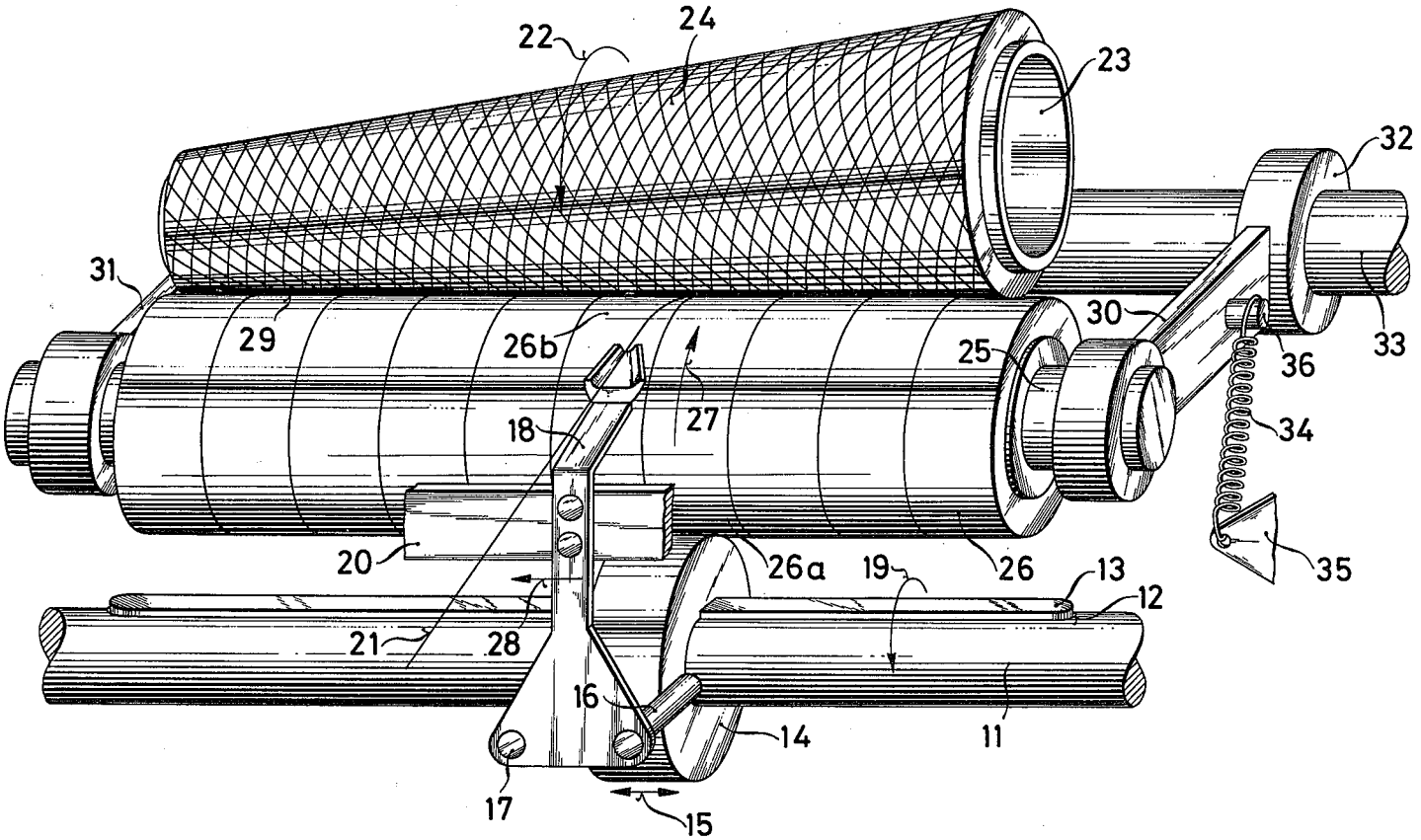

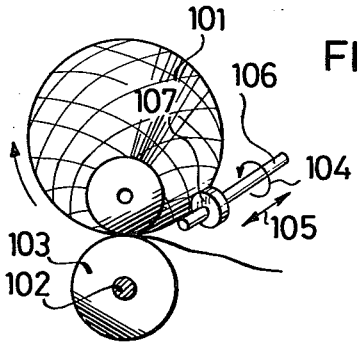
FIG. 5
FIG. 6
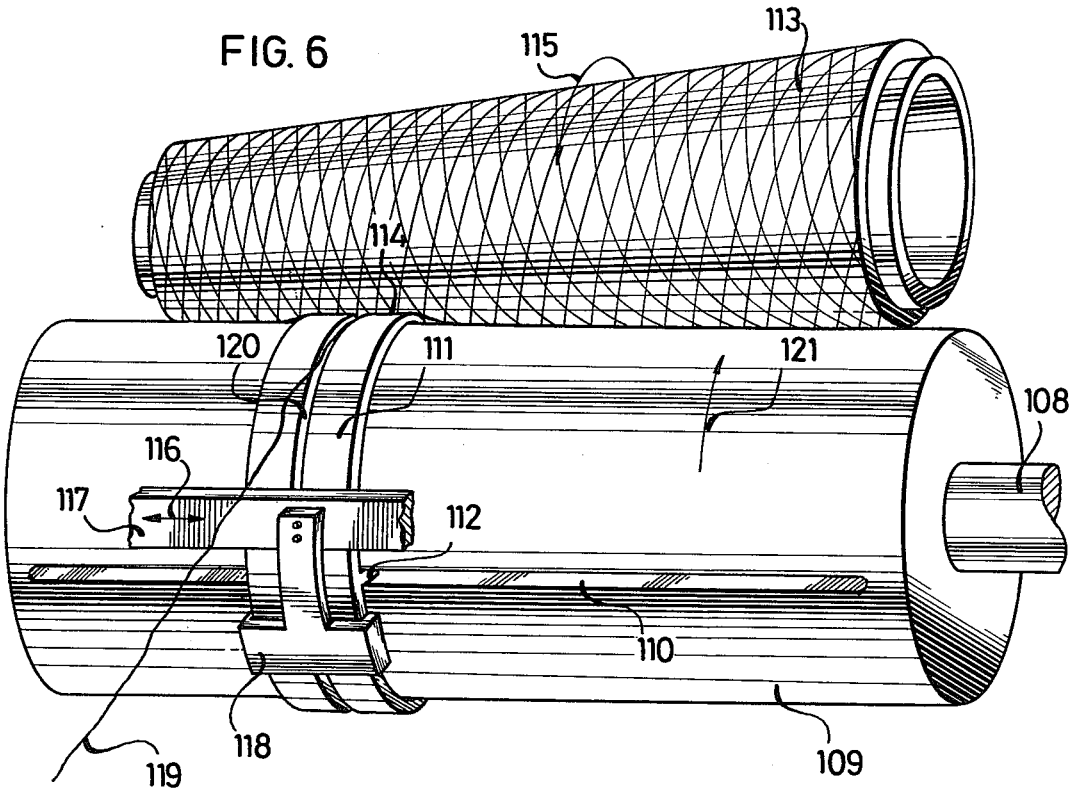

WINDING APPARATUS FOR FRICTION-DRIVEN CONICAL CROSS-WOUND COILS

The invention relates to winding apparatus for friction-driven conical cross-wound coils or cheeses. The production of such textile coils presents problems if the thread is supplied with constant velocity, as is the case in spinning frames, for example. Since the circumference of the coil or bobbin is variable both within a thread layer as well as with increasing coil fullness, the coil cannot be driven at constant speed.

It has been proposed heretofore in German Pat. No. DT-PS 485,350 to rotate the conical cross-wound coil or bobbin by means of a reciprocating spherical drive roller and to couple this drive roller simultaneously with a thread guide. It has also been proposed heretofore in German Pat. No. DT-PS 496,133 to effect the drive of the conical coil by a raised curved or cam track on a roller or on an endless belt traveling over two rollers, which corresponds with respect to shape and position to the curve or cam causing the reciprocating motion of the thread guide.

These heretofore known devices have the disadvantage, however, that the conical cross-wound coil begins to jump or dance on the reciprocating spherical drive roller or the raised curved or cam track disposed on a roller or on an endless belt even after only a short period of winding, whereby fluctuating thread tensions occur, and the surface of the coil acquires a wave-shaped appearance and varying density of the winding. The cause of these negative phenomena is that the coil is always driven and supported simultaneously only at one narrowly confined location and it is therefore completely impossible to smooth out or even prevent the undesirable development of furrows on the surface of the coil.

It is an object of the invention to avoid the aforementioned disadvantages of the heretofore known winding apparatus of this general type and to render possible, in a relatively simple manner, the winding of a satisfactory conical cross-wound coil at uniform thread supply velocity.

With the foregoing and other objects in view, there is provided, in accordance with the invention, in apparatus for winding a friction-driven conical cross-wound coil, at least one first rotating member in the form of a body of rotation disposed so as to support the coil at the peripheral surface thereof from below without directly driving the coil by friction, and a second rotating member engaging the peripheral surface of the coil from below for effecting direct frictional drive of the coil.

The apparatus according to the invention affords support of the coil also at those locations at which the coil is not being driven. Since the support of the coil is more effective the more the coil increases in fullness, it is sufficient in most cases for the support of the coil, in accordance with the invention, to begin after only a few layers of the winding have been applied and then to last until the entire coil has become fully wound.

In accordance with another feature of the invention, a plurality of the first rotating members, which do not directly effect the drive of the coil, have a common axis, which is not identical with i.e. differs from, the axis of rotation of the second rotating element, which effects the coil drive directly. In an apparatus incorporating this feature of the invention, not only the functions of driving and supporting the coil, but also the individual component parts required therefor are completely separated.

In accordance with a further feature of the invention, the at least one first rotating member which does not directly effect the drive of the coil, and the second rotating member, which effects the drive of the coil directly, have a common rotary axis. In this case, yet further advantageous embodiments are obtained, which will be discussed hereinafter in greater detail.

In accordance with yet another feature of the invention, the second rotating member, which effects the bobbin drive directly, has means defining a slot for receiving therein and guiding a thread to be wound on the coil.

In accordance with an added feature of the invention, the winding apparatus includes a thread guiding member for guiding a thread to be wound on the coil, the thread guiding member being reciprocatingly displaceable in axial direction of the coil and being coupled with the second rotating member so that the second rotating member is axially displaceable in synchronism with the displacement of the thread guiding member. If the second rotating member, which effects the coil drive directly, is in the form of a ring or a roller, circular groove or slot means may be provided in accordance with the invention for guiding the thread. Coupling of the second rotating member to a reciprocating thread guide can be effected by holding means that are clamped around the ring or the roller. The holding means may be provided with appropriate anti-friction roller or slide bearings for minimizing friction losses.

In accordance with an additional feature of the invention, the winding apparatus includes a plurality of the first rotating members, the plurality of the first rotating members and the second rotating member collectively comprising a multiplicity of similar rotating members mounted on a common shaft, the second rotating member being a continuously selectively changeable one of the similar rotating members. More specifically, the embodiment of the invention incorporating this novel feature, preferably has at least three similar rotating members disposed on a common shaft. A successively different one of the similar rotating members takes over the drive in continuously changing fashion, while the other members rotatingly support the coil without per se driving the coil. No axial displacement of the rotating members takes place, which serves to preserve or protect the coil winding advantageously.

In accordance with a further feature of the invention, the winding apparatus includes an auxiliary device coupled with the thread guiding member for selecting and driving the second rotating member.

In accordance with another feature of the invention, the auxiliary device comprises an axially displaceable rotating friction roller coupled with the thread guiding member. The friction roller may be driven continuously or may be engageable with and disengageable from a continuously rotating driving device. A reciprocating thread guide, for example, leads the continuously driven friction roller in synchronism with its own motion in a straight line over the surface of the rotating members which are lined up closely together on a shaft and which rotate, in fact, because of the contact thereof with the cross-wound coil, while they do not actually drive the latter. Only that rotating member which is in contact with the friction roller takes over temporarily the drive of the cross-wound coil at any one time.

The friction roller can also be provided, in accordance with the invention, with its own driving device which is only indirectly coupled with the thread guiding element.

If the friction roller is given a driving device of its own for its axial displacement, the path of the axial displacement as well as the mass acceleration may advantageously be smaller than in the aforedescribed embodiment, because the friction roller need not be led over the entire length of the cross-wound coil and, in contrast with the thread guide, the reversal of the direction of displacement need not take place suddenly, but can occur with gentle deceleration and acceleration. This advantage is all the more noticeable, the fewer similar rotating members are disposed on a common axis for the support of the coil.

In the last-mentioned embodiments of the invention, the common shaft of the rotating members is advantageously articulatingly suspended and is, in addition, forcibly urged by weight- or spring-loading in direction toward the friction roller. This is to ensure constant contact pressure and to compensate, if necessary, for gradual wear.

In accordance with another feature of the invention, the second rotating member, which effects the coil drive directly, is looped about the first rotating member, which does not effect the coil drive directly, and is displaceable in axial direction relative to the first rotating member. The second rotating member, which effects the drive of the coil, thus surrounds, in some manner, the first rotating member, which merely supports the coil. In this embodiment of the invention, the supporting rotating member is able to make contact with the coil surface only after several winding layers have been applied, and, in fact, the sooner contact occurs, the softer is the coil and the smaller is the distance of the supporting rotating member from the coil surface at the start of the winding process. Since the disturbing unevennesses on the coil surface become apparent also only after several winding layers are formed, without applying the invention of the instant application such a construction is sufficient in most situations where the invention is applied.

In accordance with an additional feature of the invention, means are provided by which the second rotating member which effects the coil drive directly, is form-lockingly driven by the first rotating member, which does not effect the coil drive directly, so as to frictionally drive the coil, in turn.

It is a prerequisite that the first rotating member be continuously driven during the winding process. Accordingly a certain amount of slippage between the coil surface and the surface of the first rotating member is unavoidable at those locations at which the cross-wound coil is merely supported but not driven. The slippage is less, the less conical the coil is. With the cone angles usually found in practice, the slippage is harmless also to fragile threads. A disturbance of the drive due to the aforementioned slippage could not be determined, especially since the contact pressure in the zone of the drive is always substantially higher than in the zone of the coil support.

In accordance with yet another feature of the invention, the second rotating member, which effects the coil drive directly, comprises a ring of relatively slight wall thickness having an inner diameter larger than the outer diameter of the first rotating member which does not effect the drive of the coil.

In a practical embodiment of the invention, the first rotating member which does not effect the coil drive directly, is provided with the form of a cylinder or roller which extends along the entire length of the coil and into which a longitudinal slot is milled. A ring of 2 to 4 mm thickness, which is axially displaceable with little play on the cylinder, has an inwardly-projecting guide member which engages in the longitudinal slot formed in the roller. A reciprocating thread guide is clamped around the ring at the narrow edge thereof and guides it reciprocatingly on the roller in rhythm with the displacement of the thread guide. At the same time, the ring rotates together with the roller.

In another embodiment of the invention, the first rotating member, which does not directly effect the drive of the coil, is likewise given the form of a cylinder or roller extending along the entire length of the coil, but has no longitudinal slot formed therein.

The ring of this embodiment has no inwardly-projecting guide member. The ring is not driven by the roller but, independently of the rotation of the roller, by a separate friction roller which, in turn, may extend along the entire length of the coil.

As an alternative to the foregoing embodiments, in accordance with a further feature of the invention, the second rotating member, which effects the coil drive directly, can also be force-lockingly driven by friction by the first rotating member, which does not directly effect the drive of the coil. The second rotating member, which effects the coil drive directly, may then, in accordance with another, more specific feature of the invention, comprise an endless belt and a tensioning roller engageable therewith. The tensioning roller and the belt, simultaneously can be guided by a thread guide in the same manner as described hereinabove with respect to the foregoing embodiment.

In an embodiment which is an alternative thereto, the second rotating member directly effecting the coil drive is again formed of a ring with a relatively slight wall thickness having an inner diameter larger than the outer diameter of the first rotating member, which does not effect the coil drive directly. The inner diameter of this ring may even be considerably larger than the outer diameter of the first rotating member, which does not directly effect the coil drive and which, in this embodiment too, has in actual practice the form of a cylinder or roller which extends along the entire length of the coil. The ring rolls on the continuously rotating roller and is driven by the roller through friction. The axial displacement of the ring is taken in charge by a separate guiding member which is controlled by the thread guide and has guiding surfaces which make contact at several locations with the ring surface and thereby hold the rotary axis of the ring always in the same position parallel to the rotary axis of the roller or cylinder.

The advantages of the invention are apparent particularly in that the production of a satisfactory conical cross-wound coil is afforded with nearly constant thread tension and uniform thread feeding velocity, without any large outlay for production means.

Besides the aforementioned advantages of the invention of the instant application, it should be noted that, due to the separation of the support and drive functions in the invention, the displacement of the coil driving member in axial direction is independent of the rotary speed thereof. This indicates continuous selective adjustability of the thread crossing angle without re-setting of the winding apparatus and without exchanging parts of this apparatus. In the winding apparatus of comparable type, known heretofore, this advantage is either not available at all or only if other disadvantages are present and must be tolerated.

Other features which are considered as characteristic for the invention are set forth in the appended claims.

Although the invention is illustrated and described herein as embodied in a winding apparatus for friction-driven conical cross-wound coils, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIGS. 1 to 4 are perspective views of part of an individual winding station of a textile machine incorporating different embodiments of the winding device according to the invention.

Referring now to the drawing and first, particularly, to FIG. 1 thereof, there is shown, in a partial view of an individual winding station of a textile machine, a winding device according to the invention. A shaft 11 extending from one winding station to the next is formed with a slot 12, in which a key 13 is received. A friction roller 14 axially displaceably disposed on the shaft 11 and the key 13, is guided in the directions of the double-headed arrow 15 by means of guide pins 16 and 17 through a reciprocating thread guiding member 18 and entrained and turned by the shaft 11 in rotary direction of arrow 19. Travel of the thread guiding member 18 in direction parallel to the axis of the shaft 11 is controlled in such manner by a push rod 20 extending from winding station to winding station, that the thread 21 is wound in crossed thread layers 24 onto the conical cross-wound coil or cheese 23 which rotates in direction of the arrow 22.

Ten similar rotating members 26 are mounted on a shaft 25. The rotating member **26*a* happens to be driven by the friction roller 14 and rotated in direction of the arrow 27. Since the thread guiding member 18 happens to be moving in direction of the arrow 28, the friction roller 14 is just about to change over from the rotating member 26*a* to the rotating member 26*b*, which is being rotated, therefore, partly by the friction roller 14 and partly by the cross-wound bobbin 23 that is, in turn, frictionally driven directly by the rotating member 26*a* in the direction of the arrow 22. All the other rotating members 26 do not effect the drive of the coil 23; they are rather set into rotation by the coil 23 through friction and support the coil 23 from below along a line 29, at which they engage the surface of the coil 23**.

The common shaft 25 of the rotating members 26 is articulatingly suspended by means of holders 30 and 31 and bearing bushings 32 secured thereto, from a shaft 33 firmly connected to the frame of the textile machine. Because of this articulating suspension, the weight of the shaft 25 and all of the parts connected thereto rests on the friction roller 14 and that rotating member 26 which is selected by the thread guiding member 18 and directly effects the coil drive. The contact pressure is augmented by a tension spring 34, which is disposed between a spring cross-piece or traverse 35 of the machine frame and a spring pin 36 extending from the holder 30.

During the operation of the winding device of the invention, each of the 10 rotating members 26 alternately takes over the function of the member which directly effects the coil drive. The selection of the particular effective member 26 is made by an auxiliary device formed of the friction roller 14 and the guide pins 16 and 17 and coupled with the thread guiding member 18. If the friction roller 14 rotates with constant peripheral speed, a uniformly supplied thread 21 will be wound on the cross-wound coil also with constant peripheral speed.

Figure 2:
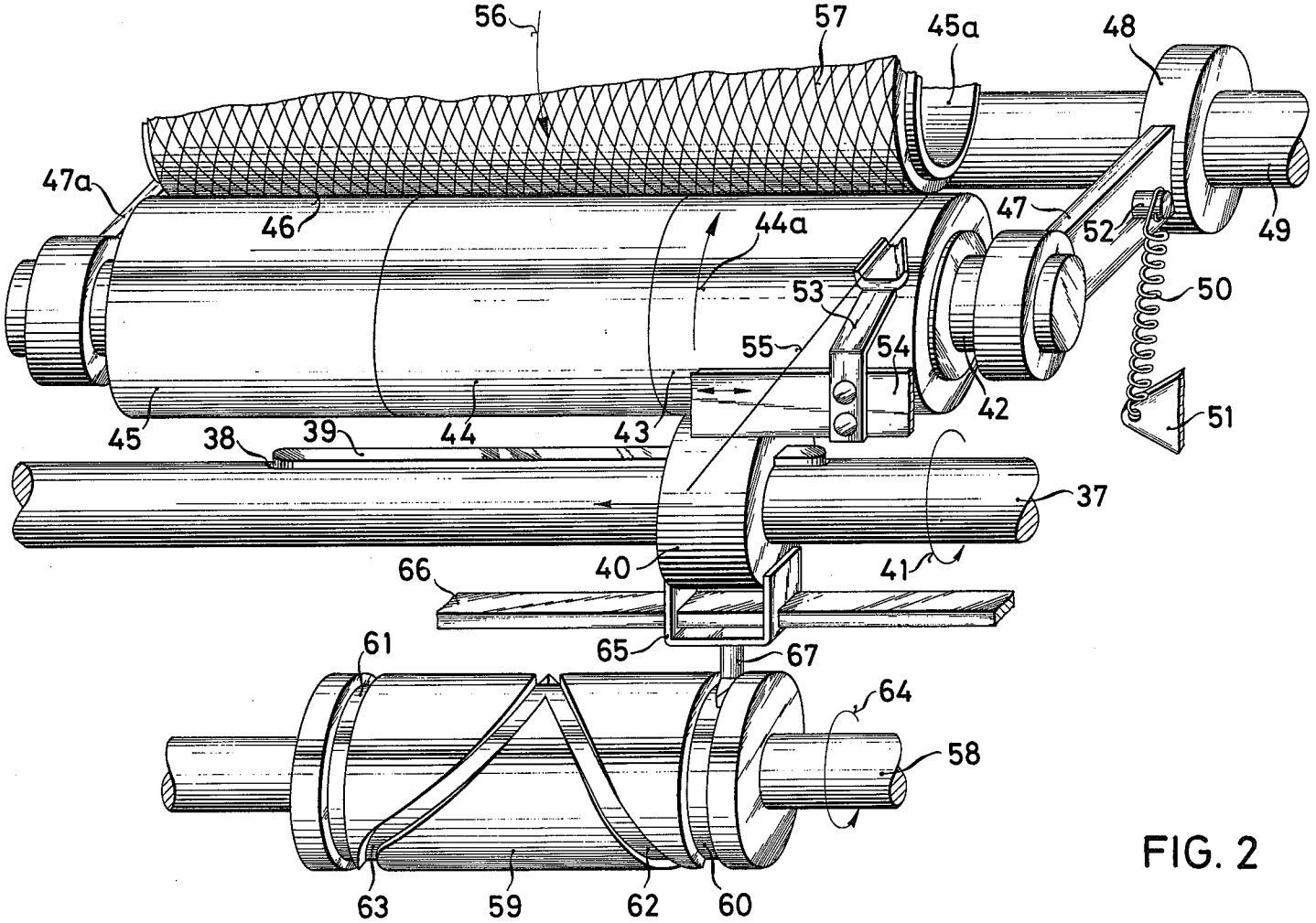

A somewhat different embodiment of the invention is shown in FIG. 2, wherein a shaft 37 extending from winding station to winding station is formed with a slot 38 in which a key 39 is received. A friction roller 40, which is disposed axially displaceably on the shaft 37 and the key 39, is entrained and rotated by the shaft 37 in the direction of the arrow 41.

Three similar rotating members 43, 44 and 45 are mounted on a shaft 42. The rotating member 43 happens to be driven by the friction roller 40 and rotated in the direction of the arrow **44*a*, as shown in FIG. 2, thereby driving, in turn, the conical cross-wound coil 45*a* by friction. The other two rotating members 44 and 45 do not effect the drive of the coil 45*a*; they are rather set in rotation through friction by the coil 45*a* and support the coil from below along the line 46**, at which they engage the surface of the coil.

The common shaft 42 for the rotating elements 43, 44 and 45 is articulatingly suspended from the shaft 49 by means of holders 47 and **47*a* and bearing bushings 48 secured thereto. The shaft 49** is firmly connected to the non-illustrated machine frame.

Because of this articulating suspension, the weight of the shaft 42 and all parts connected therewith rests on the friction roller 40 and the particular rotating member which at the time directly effects the coil drive. The contact pressure is augmented by a tension spring 50, which is disposed between a spring cross piece 51 secured to the nonillustrated machine frame, for example, and a spring pin 52 extending from the holder 47.

A thread guiding member 53 is controllably guided parallel to the axis of the shaft 37, by a push rod 54 extending from winding station to winding station, in such a manner that the thread 55 is wound in crossed layers 57 upon the conical cross-wound coil **45*a* rotating in the direction of the arrow 56**.

A reverse-winding cylinder or traverse 59 is mounted on a shaft 58 which extends from winding station to winding station. The reverse-winding cylinder 59 has guide slots 60, 61, 62 and 63 formed in the surface thereof. The guide slots 60 and 61 have a switch of known construction, not shown in detail, and are moreover disposed in curcular fashion around the reverse-winding cylinder 59. The guide slot 62 follows the course of a right-handed helix and the guide slot 63 follows that of a left-handed helix. The helices of the guide slots 62 and 63 merge at the respective switches into the circular form of the guide slots 60 and 61.

The shaft 58 rotates in the direction of the arrow 64, making two revolutions during the time in which the thread guiding member 53 travels once across the entire length of the coil. A guide element 67, guided on a bar 66 by means of a fork 65, follows the contours of the guide slots. Accordingly, the rotating friction roller 40 is entrained by the fork 65 and shifted axially on the shaft 37 with a reciprocating motion.

The shift path is only about two-thirds as long as the travel path of the thread guiding member 53 during one thread guiding stroke.

In this embodiment of the invention shown in FIG. 2, the friction roller 40 is therefore not coupled directly to the motion of the thread guiding member 53. This yields the advantage that the sudden deceleration and renewed acceleration that are absolutely necessary for the thread guiding member 53 at the thread reversal point at the end of the coil, need not be executed also by the friction roller 40. It suffices if the friction roller 40, as is shown in FIG. 2, in the end position reaches at most to about the middle of the length of the rotating member 43 or 45, respectively, while the thread guiding member 53 travels simultaneously to the respective coil end. One can therefore operate with little deceleration and acceleration at the reversal point of the direction of movement of the friction roller 40.

As can be seen in FIG. 2, the friction roller 40 is in the right-hand end position thereof. As the shaft 58 continues to rotate in the direction of the arrow 64, the guide member 67 is lead from the guide slot 60 into the guide slot 63 and subsequently into the guide slot 61. The friction roller 40 is entrained by the fork 65, the rotating members 44 and 45 taking over the drive of the bobbin 45*a*. The return of the friction roller 40 is brought about by means of the guide slot 62.

The reverse-winding cylinder 59 can alternatively also be disposed for use in common by several or all of the winding stations of a textile machine. Then the guidance of the friction roller 40 must be effected by a push rod, thereby deviating from the embodiment shown in FIG. 2.

In the embodiment of the invention shown in FIG. 2, there are only three rotating members 43, 44 and 45, and the coil 45*a* can therefore be driven only in three speed steps or stages. This is sufficient in many applications, if the shaft 37 is driven somewhat faster than would correspond to the speed at which the thread 55 is supplied. Then, velocity differences are compensated for by more or less slippage occurring at the line 46 between the coil 45*a* and that rotating member which effects the coil drive directly. The slippage occurs because the thread 55 tries to hold the coil 45*a* back.

Figure 3:
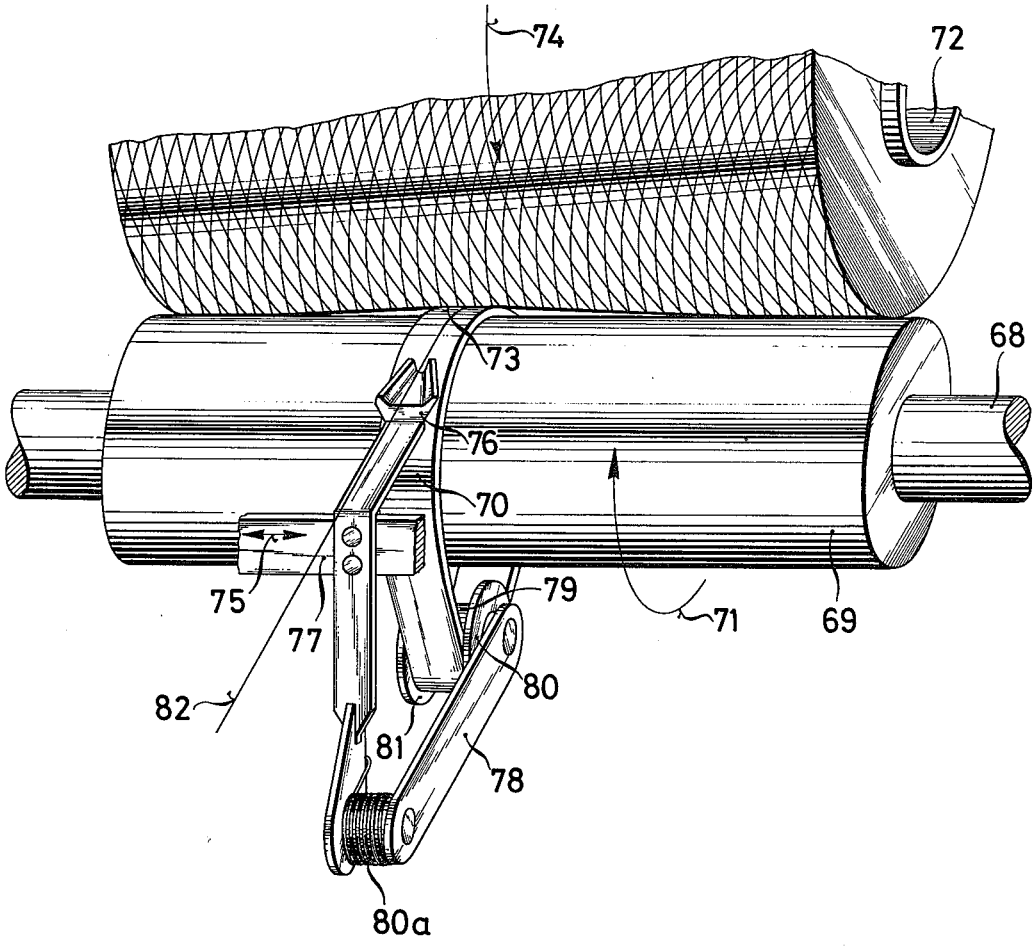

Another embodiement of the invention is shown in FIG. 3. In this embodiment, also, partial view of a winding station of a textile machine is shown. A cylindrical rotating member 69 is fastened on a shaft 68 which extends from winding station to winding station. A rotating member 70 which effects the coil drive directly and has the form of an endless belt is driven positively or force-lockingly by friction transmission from the member 69 which rotates in the direction of the arrow 71 and does not effect the drive of the coil directly. A conical cross-wound coil 72, shown only in a partial view, rolls on the rotating element 70 at the contact line 73 and is thereby set in rotation in the direction of the arrow 74 by friction. To the left-hand and right-hand sides, next to the contact line 73 as viewed in FIG. 3, the surface of the coil 72 also makes contact with the rotating member 69. The coil 72 is thereby supported from below but is not driven, because the contact pressure at these locations is less than at the contact line 73. Since it is not desired that the coil 72 be driven by the rotating member 69, the latter advantageously has a surface with a low coefficient of friction, but the rotating member 70, which effects the drive of the coil 72 directly, has an outer surface with a high coefficient of friction.

A thread guiding member 76, which can be reciprocated in the direction of the arrow 75 by means of a push rod 77, is articulatingly connected to a tensioning-roller bracket 78, at the end of which a tensioning roller 79 is rotatably supported. The belt-formed rotating member 70 is looped around the tensioning roller 79. Pre-tensioning of the tensioning roller 79 is provided by a coil torsion spring 80*a*.

Since the tensioning roller 79 has two high flanges or rims 80 and 81, the rotating member 70 is entrained thereby in synchronism with the motion of the thread guiding member 76, so that the coil 72 is always driven at that location at which the thread 82 happens to be running up onto the coil 72. When the rotary speed of the shaft 68 is constant, this occurs with constant peripheral speed of the coil at the run-up point of the thread.

Figure 4:
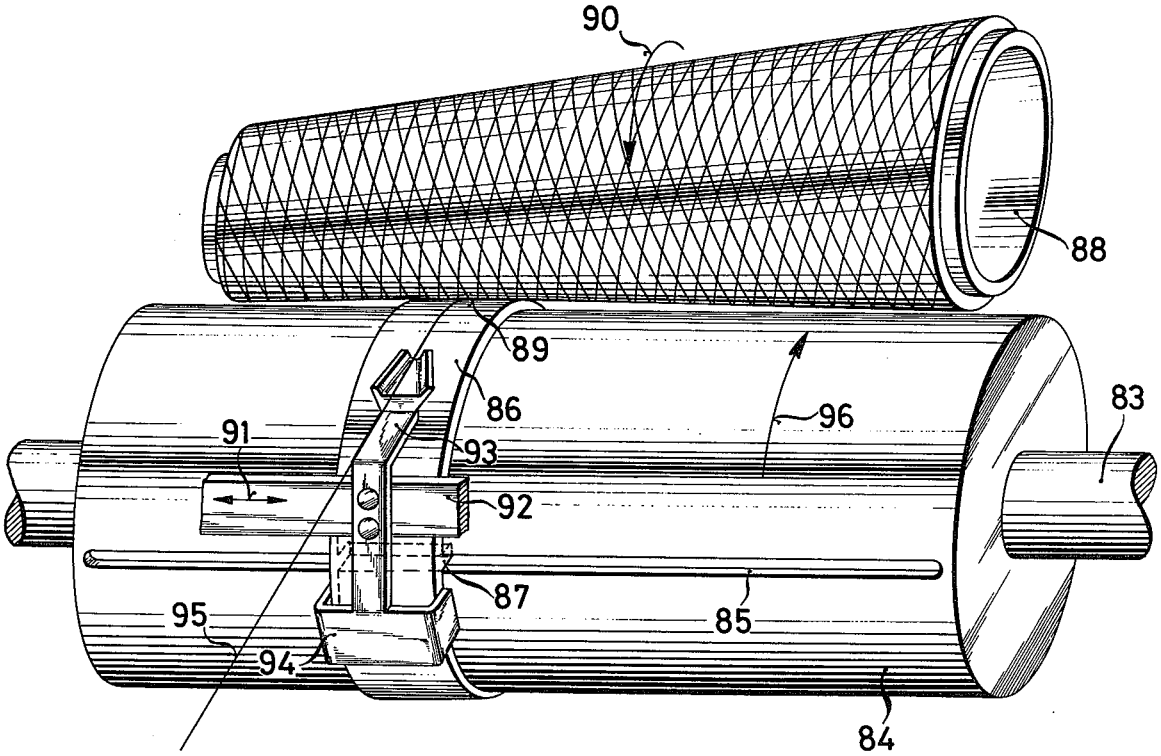

An embodiment of the invention is shown in FIG. 4 which is somewhat different from that of FIG. 3. A cylindrical rotating member 84, which is formed with a narrow longitudinal groove 85, is secured on a shaft 83, that extends from winding station to winding station. A rotating member 86 which effects the drive of the coil 88 directly and has the form of a ring of relatively slight wall thickness, is driven form-lockingly by the rotating member 84. This is brought about by a cross-piece or leg 87 which extends from the inner surface of the ring 86 and engages in the slot 85 formed in the rotating member 84. The inner diameter of the ring 86 is only slightly larger than the outer diameter of the rotating member 84.

A conical cross-wound coil or cheese 88 rolls on the rotating member 86 at the contact line 89 and is thereby set in rotation by friction in the direction of the arrow 90. A thread guiding member 93, displaceable reciprocatingly in the direction of the arrow 91 by means of a push rod 92, has a guide fork 94 which is clamped around the rotating member 86 at the relatively narrow edge thereof and guides the same. The rotating member 86 is thus entrained in synchronism with the motion of the thread guiding member 93 in such a manner that the coil 88 is always driven at that location at which the thread 95 happens to run up on the coil 88. When the rotary speed of the rotating member 84 is constant in the direction of the arrow 96, this occurs with constant peripheral speed of the coil 88 at the location at which the thread runs up.

The coil 88 is not very full. To the left-hand and right-hand sides next to the contact line 89, as seen in FIG. 4, the surface of the coil 88 is close to the surface of the rotating member 84 but does not touch the latter. However, with increasing fullness of the coil 88, the rotating member 84, which does not effect the drive of the coil 88 directly, will make contact with the surface of the coil 88 and the latter will be supported from below by the rotating member 84.

Another embodiment of the invention is shown in the end perspective view of FIG. 5. A conical cheese 101 lies on rotating elements 103 which are, in turn, rotatably mounted on a shaft 102. The rotating elements 103 extend over the entire length of the cheese or coil 101. Only the end rotating element 103 is actually visible in FIG. 5. The rotating elements 103 do not effect the drive of the coil or cheese 101, but rather are set into rotation by the rotating coil 101. In this regard, there is provided, adjacent the coil 101, a shaft 106 which is rotatable in direction of the curved arrow 104 and which is shiftable in direction of the double-headed arrow 105 parallel to the conical surface of the coil 101, the shaft 106 carrying a rotating element 107 which is in the form of a friction roller. The friction roller 107 presses against the surface of the coil 101 and, accordingly, rotates the coil 101.

The functions of the drive and the support for the cheese or coil 101 and the detailed components necessary therefor, are completely separated from one another in this embodiment of the invention shown in FIG. 5 of the drawing.

Yet another embodiment of the invention is shown in FIG. 6 wherein a roller-shaped rotating element 109 formed with a narrow groove 110 is mounted on a shaft 108 which extends from spinning station to spinning station of the spinning machine. A rotating element 111 in the form of a ring is form-lockingly driven by the rotating element 109 and produces direct drive of the cheese or conical coil 113. This is effected by means of cross-piece or leg 112 extending from the inner surface of the rotating element 111 and engaging in the groove 110 of the rotating element 109.

The rotating element 111 is disposed around the rotating element 109, the inner diameter of the rotating element 111 being only slightly larger than the outer diameter of the rotating element 109.

The conical coil or cheese 113 rolls on the contact line 114 which it has with the rotating element 111 and is set in rotation by friction in direction of the curved arrow 115. A guide fork 94, which is clamped around the rotating element 11 at the relatively narrow edge thereof and guides the same, is displaceable reciprocally by means of a push rod 117 in direction of the double-headed arrow 116. The conical coil or cheese 113 is thus always driven at the location at which the thread 119 which is guided in a thread guiding groove 120 formed in the rotating element 111, and runs rectilinearly on to the cheese or coil 113. This occurs at a constant peripheral speed of the rotating element 109 in direction of the curved arrow 121 and also with constant peripheral speed of the conical coil or cheese 113 at the respective location at which the thread runs up onto the cheese or coil 113.

Only a few possible embodiments of the invention are illustrated in the drawing and, as noted hereinbefore, the invention is by no means limited thereto. Further embodiments are conceivably within the scope of the claims, some of them having been previously mentioned in the introduction to the specification.

There are claimed:

1. In apparatus for winding a friction-driven conical crosswound coil, a plurality of first rotating members in the form of bodies of rotation disposed so as to support the coil at the peripheral surface thereof from below without directly driving the coil by friction, and a second rotating member engaging the peripheral surface of the coil from below for effecting direct frictional drive of the coil, said first rotating members having a common rotary axis, said second rotating member having a rotary axis differing from that of said plurality of first rotating members.

2. In apparatus for winding a friction-driven conical crosswound coil, at least one first rotating member in the form of a body of rotation disposed so as to support the coil at the peripheral surface thereof from below without directly driving the coil by friction, and a second rotating member engaging the peripheral surface of the coil from below for effecting direct frictional drive of the coil, said second rotating member having means defining a slot for receiving therein and guiding a thread to be wound on the coil.

3. In apparatus for winding a friction-driven conical crosswound coil, at least one first rotating member in the form of a body of rotation disposed so as to support the coil at the peripheral surface thereof from below without directly driving the coil by friction, a second rotating member engaging the peripheral surface of the coil from below for effecting direct frictional drive of the coil and a thread guiding member for guiding a thread to be wound on the coil, said thread guiding member being reciprocatingly displaceable in axial direction of the coil, and being coupled with said second rotating member so that said second rotating member is axially displaceable in synchronism with the displacement of said thread guiding member.

4. In apparatus for winding a friction-driven conical crosswound coil, a plurality of first rotating members in the form of bodies of rotation disposed so as to support the coil at the peripheral surface thereof from below without directly driving the coil by friction, a second rotating member engaging the peripheral surface of the coil from below for effecting direct frictional drive of the coil, said plurality of said first rotating members and said second rotating member collectively comprising a multiplicity of similar rotating members mounted on a common shaft, said second rotating member being a continuously selectively changeable one of said similar rotating members, and including thread guiding means for guiding a thread to be wound on the coil, and an auxiliary device coupled with said thread guiding means for selecting and driving said second rotating member.

5. Winding apparatus according to claim 4 wherein said auxiliary device comprises an axially displaceable rotating friction roller coupled with said thread guiding means.

6. Winding apparatus according to claim 5 wherein said common shaft on which said similar rotating members are mounted is articulatingly suspended and is forcibly urged in direction toward said friction roller.

7. In apparatus for winding a friction-driven conical crosswound coil, at least one first rotating member in the form of a body or rotation disposed so as to support the coil at the peripheral surface thereof from below without directly driving the coil by friction, and a second rotating member engaging the peripheral surface of the coil from below for effecting direct frictional drive of the coil, said second rotating member being looped about said first rotating member and being displaceable in axial direction relative to said first rotating member.

8. Winding apparatus according to claim 7 including means by which said second rotating member is form-lockingly driven by said first rotating member so as to frictionally drive the coil, in turn.

9. Winding apparatus according to claim 8 wherein said second rotating member is force-lockingly driven by friction by said first rotating member so as to drive the coil frictionally, in turn.

10. Winding apparatus according to claim 7 wherein said second rotating member looped about said first rotating member comprises an endless belt and a tensioning roller engageable therewith.

11. Winding apparatus according to claim 7 wherein said second rotating member looped about said first rotating member comprises a ring of relatively slight thickness having an inner diameter larger than the outer diameter of said first rotating member.

* * * * *